US005758878A

United States Patent [19]

Brown

[11] Patent Number: 5,758,878

[45] Date of Patent: Jun. 2, 1998

[54] DEVICE FOR COMBINING BACCARAT AND CRAPS

[75] Inventor: J. Breck Brown, Las Vegas, Nev.

[73] Assignee: Steven R. Pyykkonen, Leonard, Mich.; a part interest

[21] Appl. No.: 822,582

[22] Filed: Mar. 20, 1997

Related U.S. Application Data

[62] Division of Ser. No. 753,426, Nov. 25, 1996, Pat. No. 5,669,606.

[51] Int. Cl.[6] ..... A63F 1/00

[52] U.S. Cl. ..... 273/274; 273/292

[58] Field of Search ..... 273/292, 274, 273/309

[56] References Cited

U.S. PATENT DOCUMENTS

| | | | |
|---|---|---|---|
| 4,515,369 | 5/1985 | Johnson . | |
| 4,746,126 | 5/1988 | Angileri . | |
| 4,836,553 | 6/1989 | Suttle et al. . | |
| 4,861,041 | 8/1989 | Jones et al. . | |
| 5,078,405 | 1/1992 | Jones et al. . | |
| 5,257,810 | 11/1993 | Schorr et al. | 273/309 |
| 5,288,077 | 2/1994 | Jones . | |
| 5,288,081 | 2/1994 | Breeding . | |
| 5,328,189 | 7/1994 | Malek | 273/309 |
| 5,395,120 | 3/1995 | Malek . | |
| 5,417,430 | 5/1995 | Breading . | |
| 5,540,444 | 7/1996 | Nguyen | 273/292 |
| 5,556,101 | 9/1996 | Jabro | 273/309 |
| 5,584,486 | 12/1996 | Franklin | 273/274 |
| 5,639,092 | 6/1997 | Macaisa | 273/292 |

*Primary Examiner*—William M. Pierce
*Attorney, Agent, or Firm*—Howard & Howard

[57] ABSTRACT

A method and game board (10) are shown for combining the play of baccarat based upon at least one card deck having fifty-two cards divided into four suites of duces through aces and the play of craps based upon two dice (28) each having six faces numbered one to six. The board presents a semi-circular playing arena with a plurality of card indicia or spots (15 and 17) to indicate positions for the dealer to place the respective player and banker cards as they are dealt and a plurality of player areas spaced about the circumference of the circular periphery of said semicircular playing arena. Each of the player areas comprises a rectangular player box (18) for placing a baccarat wager on the player hand (17), a rectangular banker box (20) for placing a baccarat wager on the banker hand (15), and a plurality of craps wager indicator circles (12, 14 and 16) dividing the dice numbers 2 through 12 into a plurality of groups for wagering at different odds for each group. Tie wager indicia (24) are included for offering a baccarat wager in the form of a tie wager to each player whereby the player may wager that the player hand will tie the banker hand. In the event that the player hand ties the banker hand under the rules of baccarat, each player who placed a tie wager is offered the roll of the dice and a craps wager on one of the craps wager circles. Each craps wager is settled based on the outcome of the roll of the dice. In addition, at the beginning of each hand, each player is offered an accumulated pot wager on one or more of the craps wager indicators (12, 14 and 16), which pot wagers arc accumulated without payout until the banker hand ties the player hand with a predetermined combination of cards, whereupon a player is selected to roll the dice from the players who placed an accumulative pot wager.

5 Claims, 1 Drawing Sheet

DEVICE FOR COMBINING BACCARAT AND CRAPS

This is a Divisional of application Ser. No. 08/753,426 filed on Nov. 25, 1996, now U.S. Pat. No. 5,669,606.

TECHNICAL FIELD

The subject invention relates to a combination card and dice game.

BACKGROUND ART

Various games are known in the prior art which combine standard playing cards and two dice. The U.S. Pat. No. 4,746,126 to Angileri discloses a game utilizing the attributes of craps with the play of cards wherein the play of the cards is dependent upon the throw of the dice. The U.S. Pat. No. 4,515,369 discloses a game combining the elements of craps and blackjack wherein the rules of blackjack apply to movement of game pieces as determined by the roll of the dice. Yet another U.S. Pat. No. 5,395,120 to Malek discloses a method and apparatus for simultaneously playing draw poker and twenty-one.

SUMMARY OF THE INVENTION AND ADVANTAGES

A method of combining the play of baccarat and craps comprising the steps of offering baccarat wagers in the form of a player wager that the player hand will win, a banker wager that the banker hand will win, and a tie wager that the cards of the player hand will tie the cards of the banker hand, all in accordance with the rules of baccarat. Included are the further steps of presenting at least two cards to a player hand and at least two cards to a banker hand and additional cards to each of the two player and banker bands in accordance with the rules of baccarat, then settling the baccarat wagers. The method also includes the offering of a plurality of craps wagers based respectively on a plurality of groups of dice numbers with each group of dice numbers having different betting odds and establishing a craps wager on at least one of the groups of dice numbers for each participating player. The steps conclude with offering the roll of two dice to at least one player when the cards of the player hand ties the cards of the banker hand under the rules of baccarat and settling the craps wagers based the outcome of the roll of the dice.

The invention also includes an amusement device for combining the play of baccarat and craps comprising a presenter for positioning at least two cards for a player hand and two cards for a banker hand, player wager indicia for offering a baccarat wager in the form of a player wager that the player hand will win, banker wager indicia for offering a baccarat wager in the form of a banker wager that the banker hand will win, tie wager indicia for offering a baccarat wager in the form of a tie wager that the cards of the player hand will tie the cards of the banker hand in accordance with the rules of baccarat, a plurality of craps wager indicators for offering a plurality of craps wagers based respectively on a plurality of groups of dice numbers with each group of dice numbers having different betting odds, and a dice rolling mechanism for rolling dice.

BRIEF DESCRIPTION OF THE DRAWINGS

Other advantages of the present invention will become readily appreciated as the same becomes better understood by reference to the following detailed description when considered in connection with the accompanying drawings wherein FIG. 1 discloses a game board illustrating the subject invention.

DETAILED DESCRIPTION OF PREFERRED EMBODIMENT

Figure 1:
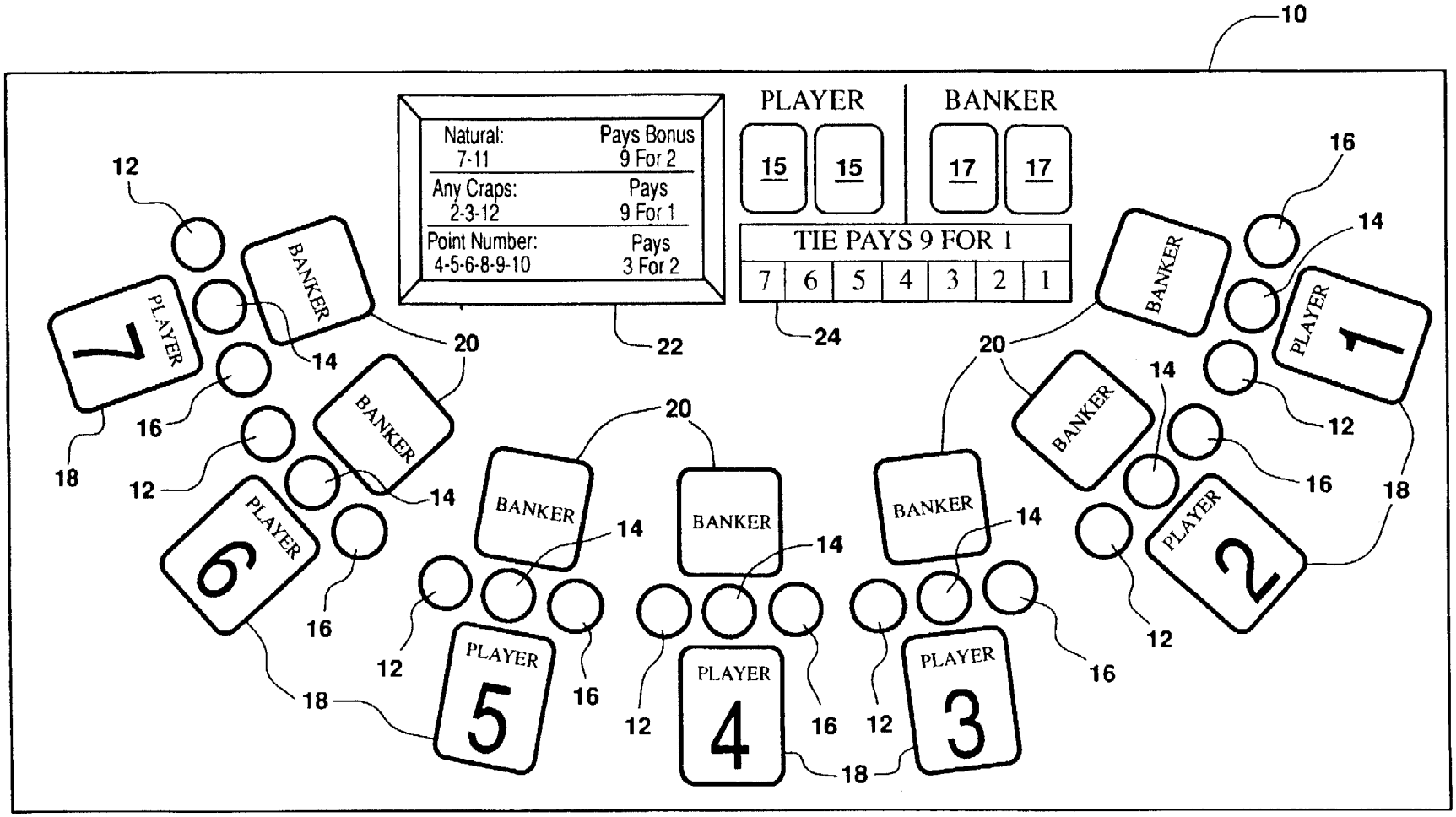

As illustrated in FIG. 1, the device is a game board generally indicated at 10 for combining the play of baccarat based upon at least one but usually a plurality of card decks each having fifty-two cards divided into four suites of duces through aces and the play of craps based upon two dice each having six faces numbered one to six. The device takes the form of a mat, table cloth or cover, place mat, or the like; however the game may be implemented in a computer program producing images for a monitor. In any case, the device comprises a presenter for positioning at least two cards for a player hand and two cards for a banker hand. As illustrated, the board 10 comprises an upper playing surface which presents a semi-circular playing arena, defined by the semi-circle and the straight diameter. A plurality of player areas spaced about the circumference of the circular periphery of the semi-circular playing arena and opposed to the dealer card distribution area. The board presents seven player areas spaced about the semi-circular playing arena. A plurality of craps wager indicators 12, 14 and 16 are included for each player area to indicate the craps wager based upon the roll of two dice by each player when the cards of the player hand tie the cards of the banker hand under the rules of baccarat.

A plurality of card indicia or spots indicate positions for the dealer to place the respective player and banker cards as they are dealt, and define a dealer card distribution area disposed adjacent the straight diameter of the semi-circular playing arena. More specifically, the dealer card distribution area is indicated by the card indicia portraying the two card squares 15 under the title 37 PLAYER" and two card squares 17 under the title 37 BANKER." This is a dealer presentation area where the dealer places or deals cards with cards under PLAYER played against the cards under BANKER. Therefore, the squares under the title 37 PLAYER" present the player hand 15 and the squares under the title 37 BANKER" present the banker hand 17.

Each of the player areas also includes a player or outer rectangular wager box 18 labeled PLAYER with these boxes numbered 1 through 7 from the dealer's left to right to indicate the numbered position of the player about the semi-circle. Each player area also includes a banker or inner rectangular wager box 20 labeled BANKER. The player wager box 18 is used for offering a baccarat wager in the form of a player wager that the player hand 15 will win and the banker box 20 is used for offering a baccarat wager on the banker hand 17 in the form of a banker wager that the banker hand 17 will win.

Three craps wager indicators 12, 14 and 16 are disposed between each player position rectangle 18 and its associated banker position rectangle 20 to divide the numbers 2 through 12 into a plurality of groups of dice numbers for wagering or betting at different odds for each group. The plurality of craps wager indicators 12, 14 and 16 are, therefore, for offering a plurality of craps wagers based respectively on a plurality of groups of dice numbers with each group of dice numbers having different betting odds More specifically, the first 12 of each of the three craps wager indicators for each player position presents a first group of dice numbers totaling either a natural of 7 or 11. The second 14 of the craps wager indicators presents a second group of dice numbers totaling any craps of 2, 3 or 12, and the third 16 of the craps wager indicators presents a third group of dice numbers totaling any of the point numbers 4, 5, 6, 8, 9, or 10.

There is also included an odds area 22 for indicating odds for each of the groups of dice numbers, i.e., each of the craps wager indicators 12, 14 and 16. The first craps wager indicator 12, which includes the first group of the total dice numbers of 7 and 11, are at first odds of nine for two. The second craps wager indicator 14, which includes the second group of dice numbers totaling any craps of 2, 3 or 12, are at second odds of nine for one. The third craps wager indicator 16, which includes the third group of dice numbers totaling any of the point numbers 4, 5, 6, 8, 9, or 10, are at third odds of three for two. The odds area 22 may be centrally located adjacent the card dealing area and indicates the first, second and third odds for the respective craps wager areas 12, 14 and 16. That is, the table pay-off odds of nine chips for two chips bet on a natural 7 or 11, the second table pay-off odds of nine chips for one chip bet on craps 2,3 or 12, and the third table pay-off odds of three chips for two chips bet on the point numbers 4,5,6,8, 9 or 10. The first true odds are three and one half to one for a natural 7 or 11, the second true odds are eight to one for craps 2, 3 or 12, and the third true odds are one to two for point numbers 4, 5, 6, 8, 9 or 10. Alternatively or in addition the odds may be indicated with indicia at each craps wager indicator 12, 14 and 16.

The board also includes tie wager indicia 24 for offering a baccarat wager in the form of a tie wager that the cards of the player hand 15 will tie the cards of the banker hand 17 in accordance with the rules of baccarat. The tie wager indicia 24 includes positions numbered 1 to 7 for offering a tie wager to each player whereby the player may wager that the player hand 15 will tie the banker hand 17. The tie wager indicia 24 also indicates that the wager odds for such a tie are nine for one. In addition to winning at these odds when the player hand 15 ties the banker hand 17, a winning player, having placed a bet on the tie, also qualifies to make a craps wager and roll the dice thereon.

Also included is a dice rolling mechanism for rolling dice. As illustrated, the dice rolling mechanism comprises a dice cup 26 containing dice 28. However, in the case of a machine, the dice roll will be accomplished electronically. In some cases the dice roll may be accomplished by cards having dice numbers.

The board may include other informative indicia like how the cards are counted and the rules of how the cards are dealt. Aces are counted as one with tens and face cards counted as zero, and all other cards at face value. Only the last digit is counted so that the cards always add up to no more than nine. If the first two card total dealt to the player boxes equals 0 to 5, the player hand 15 is dealt another card, and the banker hand 17 is dealt another card if the first two cards in the banker boxes equal 0 to 2. The player must stand with 6 or 7 and the banker hand 17 must stand with a 7. If either the player hand 15 or the banker hand 17 has 8 or 9, that hand wins. The banker hand 17 gets another card if the banker two card total equals: 3 and the player hand 15 is not an 8; 4 and the player hand 15 is 2,3,4,5,6 or 7; 5 and the player hand 15 is 4,5,6 or 7; 6 and the player hand 15 is 6 or 7.

The invention, therefore, includes a method of combining the play of baccarat and craps comprising the basic step of offering a tie wager 24 to each player whereby the player may wager that the player hand 15 will tie the banker hand 17. More specifically, the steps include offering a baccarat wager in the form of a player wager 18 that the player hand 15 will win, offering a baccarat wager in the form of a banker wager 20 that the banker hand 17 will win, and offering a baccarat wager in the form of a tie wager that the cards of the player hand 15 will tie the cards of the banker hand 17 in accordance with the rules of baccarat. Each player places either a banker wager on the banker wager box 20 immediately in front of the player or a player wager on the player wager box 18 immediately in front of the player. In addition to placing either a player wager or a banker wager, each player may also place a tie wager 24 on his player number (1, 2, . . . 7) on the tie wager indicia 24. These wagers may be placed by placing one or more chips on any one of the wager indicia 18, 20 and 24.

The next step is the offering of a first accumulated pot wager at first odds on the first craps indicator 12 including the first group of dice numbers totaling either of the natural numbers 7 or 11, but only to each player who placed a baccarat wager on one of the banker and player wager indicia 18 and 20 and/or the tie wager indicia 24. In other words, to participate in an accumulated pot, a player must place a baccarat wager on at least one of the baccarat wager indicia 18, 20 and 24, it being evident that the player can only bet on either the player hind 15 or the banker hand 17 to win but in addition to one of those bets, may also place a wager on the tie wager indicia 24. Simultaneously, each player who has placed a baccarat wager is also offered a second accumulated pot wager at second odds on the second craps indicator 14 including the second group of dice numbers totaling any of the craps numbers 2, 3 or 12 as well as a third accumulated pot wager at third odds on the third craps indicator 16 including the third group of dice numbers totaling any of the point numbers 4, 5, 6, 8, 9, or 10.

The play continues by presenting at least two cards to each of the player hand 15 and the banker hand 17 at the respective boxes 15 and 17. Of course, additional cards are delivered to each of the player 15 and banker 17 hands in accordance with the rules of baccarat.

At this point, the next step is normally the settling of the baccarat wagers in accordance with house rules. Usually, the player and banker indicia wagers 18 and 20 are paid one for one whereas the tie wagers are paid nine for one, as indicated above the player numbers 24.

In the event the player hand 15 does not tie the banker hand 17, the respective first, second and third accumulated pot wagers are accumulated into respective first, second and third accumulated pots without payout until the banker hand 17 ties the player hand 15 under the rules of baccarat with a predetermined combination of cards. Although any designated cards may comprise the predetermined combination, the preferred predetermined combination of cards includes a nine of spades in each of the player 15 and banker 17 hands with the second card in each hand being a value of ten.

When the cards of the player hand 15 ties the cards of the banker hand 17 with that predetermined combination of cards, the next step is selecting a player from a first group of players who placed a baccarat wager 18 or 20 and/or 24 and placed a first accumulated pot wager 12 to roll two dice for the first group of dice numbers. Also included is the step of selecting a player from a second group of players who placed a baccarat wager 18 or 20 and/or 24 and placed a second accumulated pot wager 14 to roll two dice for the second group of dice numbers when the cards of the player hand 15 ties the cards of the banker hand 17 with that predetermined combination of cards. The method also includes the step of selecting a player from a third group of players who placed a baccarat wager 18 or 20 and/or 24 and placed a third accumulated pot wager 16 to roll two dice for the third group of dice numbers when the cards of the player hand 15 ties the cards of the banker hand 17 with that predetermined combination of cards. Obviously, since there is only one pot for each of the accumulated pot wagers 12, 14 and 16, only one player will be selected to roll for that pot. This selection is accomplished randomly, as by card draw, or the like.

Once the player from the first group has rolled the dice for the first accumulated pot, the first accumulated pot is disbursed to the first group of players when the result of the roll of the dice by the selected player for the first group equals one of the numbers in the first group. In other words, if the player selected to roll the dice for the first accumulated pot, which resulted from the accumulated wagers on the first craps indicators 12, rolls dice on which the dots on the dice total either of the natural numbers 7 or 11, the first pot is divided and disbursed to all of the players in that first group of players who placed a wager on the craps indicia 12. Preferably, the first accumulated pot is disbursed seventy-five percent (75%) to the player selected to roll the dice with the remaining twenty-five percent (25%) spilt equally among the remaining players of that first group of players who placed a wager on the craps indicia 12. In a like fashion, the second accumulated pot is disbursed to the second group of players when the result of the roll of the dice by the selected player for the second group equals one of the numbers in the second group. If the player selected to roll the dice for the second accumulated pot, which resulted from the accumulated wagers on the second craps indicators 14, rolls dice on which the dots on the dice total anyone of the craps numbers 2, 3 or 12, the second accumulated pot is divided and disbursed to all of the players in that second group of players who placed a wager on the craps indicia 14. Preferably, the second accumulated pot is disbursed eighty-five percent (85%) to the player selected to roll the dice with the remaining fifteen percent (15%) spilt equally among the remaining players of that first group of players who placed a wager on the craps indicia 14. The third accumulated pot is disbursed to the third group of players when the result of the roll of the dice by the selected player for the third group equals one of the numbers in the third group. More specifically, if the player selected to roll the dice for the third accumulated pot, which resulted from the accumulated wagers on the third craps indicators 16, rolls dice on which the dots on the dice total any of the point numbers 4, 5, 6, 8, 9 or 10, the third pot is divided and disbursed to all of the players in that third group of players who placed a wager on the craps indicia 16. Preferably, the third accumulated pot is disbursed sixty percent (60%) to the player selected to roll the dice with the remaining forty percent (40%) spilt equally among the remaining players of that first group of players who placed a wager on the craps indicia 16. Accordingly, a major portion of each accumulated pot is disbursed to the player randomly selected to roll the dice for the group of players with the remainder of the that particular accumulated pot divided among the remaining players in that group.

On the other hand, in the event there is no tie with the predetermined combination of cards, a tie between the player hand 15 and the banker hand 17 may still occur other than with the predetermined combination of cards. In that case, the step is included of offering the roll of two dice to each qualifying player who placed a tie wager when the cards of the player hand 15 ties the cards of the banker hand 17 under the rules of baccarat other than with the predetermined combination of cards. In other words, there is no possibility of any player winning an accumulated pot, yet each player who placed a tie wager is offered the roll of the dice. However, before each qualified player rolls the dice, each of the other players is offered a craps wager on the first 12, second 14 and third 16 groups of dice numbers. The offer of a craps wager based upon the roll of two dice is successively made to each player when the player hand 15 ties the banker hand 17; however, in the preferred play, this offer of the roll of the dice is made only to the players who placed a tie wager on the player's number in the tie wager indicia 24. Each player who qualifies may make a craps wager by placing a wager of chips on one of the three wager areas 12, 14 or 16. In other words, the offer of a craps wager is for only on any one of the first 12, second 14 or third 16 groups of dice numbers to each player before each qualifying player rolls the dice. The amount of the wager, however, may be a multiple of the baccarat wager placed by that player, e.g., two times the wager the player made on either the player hand 15 or banker hand 17. After each qualified player places a craps wager, the first qualified player then rolls the dice and the wager for each player is settled based upon the outcome of the roll of the dice. This comprises the step of settling the craps wagers based the outcome of the roll of the dice in accordance with the first, second and third odds as set forth in the odds indicia 22. The next qualified player, i.e., the next player who placed a tie wager, then rolls the dice after having placed the craps wager in one of the three areas 12, 14 or 16. As set forth above, the offering of the craps wager includes the offer of a plurality of alternative dice number combinations in the first 12, second 14 and third 16 groups having different betting odds. More specifically, the first group of natural dice numbers 7 or 11 in the first craps indicator 12 for each player pays at first odds of nine for two; the second group of craps dice numbers 2, 3 or 12 in the second craps indicator 14 for each player pays at second odds of nine for one and the third group of point numbers 4, 5, 6, 8, 9, or 10 in the third craps indicator 16 for each player pays at third odds of three for two. Therefore, the dice number combinations of the natural 7 or 11 are at first odds, the dice number combinations of any craps 2, 3 or 12 are at second odds, and the remaining dice number combinations of the point numbers 4, 5, 6, 8, 9, or 10 are at different third odds. Of course, these odds may vary as in accordance with individual house rules.

The play of baccarat is based upon at least one and usually a plurality of card decks each having fifty-two cards divided into four suites of duces through aces and the play of craps based upon two dice each having six faces numbered one to six. It involves the placing of a wager on behalf of each player for either the player or the banker cards to win by placing chips in either the player box or the banker box in front each player. The dealer, or machine, presents two cards to the player and two cards to the banker by placing the cards on the respective card boxes. As is normal in the game of baccarat, additional cards are sequentially presented to each the player 15 and the banker 17 hands in accordance with the rules set forth above. Thereafter, the baccarat wagers are paid or settled in accordance with whether the player hand 15 or banker hand 17 wins, and dependent upon whether the player wagered on the player hand 15 or the banker hand 17, or, in the event of a tie, pays to each player having made a bet on the tie. The opportunity or option to roll two dice is dependent upon the player hand 15 tieing the banker hand 17 and is presented to each player who made a tie wager when the tie is with cards other than the predetermined combination of cards. However, before the roll of the dice, each qualified player, i.e., each player who participated in the hand, establishes a craps wager, if the player wishes to participate, based upon the roll of the two dice by placing chips on one of the three circles defining the craps indicators 12, 14 or 16, which indicate the groups of dice numbers and odds of the roll. Each qualified player then rolls the dice once and his craps wager is settled based the outcome of the roll of the dice and the odds for the group on numbers 12, 14 or 16 for which the dice were rolled. The next qualified player is then offered the craps wager and the roll of the dice with each player again offered a craps wager on one of the craps indicators 12, 14 or 16. A player qualifies to roll the dice when having placed a tie wager and the player hand 15 ties the banker hand 17. However, the additional players who did not place a tie wager may or may not be allowed to make a craps wager on the roll of the dice by the player who did place the tie wager. This will depend upon the house rules. For example, the player who only wagered on either the player hand 15 or the banker hand 17, i.e., participated in the hand of baccarat, may be allowed to place a craps wager.

Accordingly, at one seating a player may play baccarat and qualify to further bet on a craps roll of the dice each time the dealer or machine presents cards in the player hand 15 which tie the card count in the banker hand 17. This includes offering a plurality of craps wagers based respectively on a plurality 12, 14 and 16 of groups of dice numbers with each group of dice numbers having different betting odds; establishing a craps wager on at least one of the groups 12, 14 and 16 of dice numbers for each participating player; offering the roll of two dice to at least one player when the cards of the player hand 15 ties the cards of the banker hand 17 under the rules of baccarat; and settling the craps wagers based the outcome of the roll of the dice. As explained above, however, this craps wager may be executed by the placing of accumulated pot wagers which can only be won by the player hand 15 tieing the banker hand 17 with a predetermined combination of cards. Alternatively, this craps wager may be executed by offering it to the players participating in the game when the player hand 15 ties the banker hand 17 with other than the predetermined combination of cards. In this latter situation, the offer to roll the dice is only made to a qualifying player who has placed a tie wager.

As will be appreciated, the steps of the method may be executed in any order and is not to be restricted to the order described or claimed.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed:

1. An amusement device for combining the play of baccarat and craps, said device comprising:

a plurality of playing cards for positioning at least two cards for a player hand (15) and two cards for a banker hand (17);

player wager indicia (18) for offering a baccarat wager in the form of a player wager that the player hand (15) will win;

banker wager indicia (20) for offering a baccarat wager in the form of a banker wager that the banker hand (17) will win;

tie wager indicia (24) for offering a baccarat wager in the form of a tie wager that the cards of the player hand (15) will tie the cards of the banker hand (17) in accordance with the rules of baccarat;

a plurality of craps wager indicators (12, 14 and 16) for offering a plurality of craps wagers based respectively on a plurality of groups of dice numbers with each group of dice numbers having different betting odds;

a pair of dice; and a dice rolling mechanism (26, 28) for rolling said dice.

2. A device as set forth in claim 1 wherein one (12) of said craps wager indicators presents a first group of dice numbers totaling either of the natural numbers 7 or 11.

3. A device as set forth in claim 1 wherein a first (12) of said craps wager indicators presents a first group of dice numbers totaling either a natural of 7 or 11, a second (14) of said craps wager indicators presents a second group of dice numbers totaling any craps of 2, 3 or 12, and a third (16) of said craps wager indicators presents a third group of dice numbers totaling any of the point numbers 4, 5, 6, 8, 9, or 10.

4. A device as set forth in claim 1 including a plurality of player wager indicia spaced about a semi-circular playing arena, each of said player wager indicia comprising a player wager box (18) for wagering on the player hand (15) and a banker wager box (20) for wagering on the banker hand (17).

5. A device as set forth in claim 1 including an odds area (22) indicating odds for each of said groups of dice numbers.

* * * * *